US005119062A

United States Patent [19]

Nakamura et al.

[11] Patent Number: 5,119,062

[45] Date of Patent: Jun. 2, 1992

[54] MONOLITHIC TYPE VARISTOR

[75] Inventors: Kazutaka Nakamura; Hiroaki Taira; Tohru Higashi; Akinori Nakayama; Yasunobu Yoneda; Yukio Sakabe, all of Nagaokakyo, Japan

[73] Assignee: Murata Manufacturing Co., Ltd., Japan

[21] Appl. No.: 615,369

[22] Filed: Nov. 19, 1990

[30] Foreign Application Priority Data

Nov. 21, 1989 [JP] Japan ..... 1-302496

[51] Int. Cl.[5] ..... H01C 7/10

[52] U.S. Cl. ..... 338/20; 338/21

[58] Field of Search ..... 338/20, 21; 361/321, 361/117, 121

[56] References Cited

U.S. PATENT DOCUMENTS 4,383,237 5/1983 Eda et al. ..... 338/21

4,729,058 3/1988 Gupta et al. ..... 361/321

*Primary Examiner*—Marvin M. Lateef

*Attorney, Agent, or Firm*—Ostrolenk, Faber, Gerb & Soffen

[57] ABSTRACT

A monolithic type varistor in which a plurality of inner electrodes are arranged in a sintered body composed of semiconductor ceramics so as to be overlapped with each other while being separated by semiconductor ceramic layers. The plurality of inner electrodes are electrically connected to first and second outer electrodes formed on both end surfaces of the sintered body. One or more non-connected type inner electrodes are arranged between adjacent ones of the plurality of inner electrodes and are not electrically connected to the outer electrodes, each of the non-connected type inner electrodes being spaced apart from each adjacent inner electrode or non-connected type inner electrode while being separated therefrom by a semiconductor ceramic layer. Voltage non-linearity is obtained by Schottky barriers formed at the interface of the inner electrode and the semiconductor ceramic layer and the interface of the non-connected type inner electrode and the semiconductor ceramic layer. The value of the number of grain boundaries between semiconductor particles in at least one semiconductor ceramic layer is two or less.

10 Claims, 3 Drawing Sheets

MONOLITHIC TYPE VARISTOR

BACKGROUND OF THE INVENTION

1. Field of the Invention

The present invention relates generally to a monolithic type varistor functioning as a voltage non-linear resistor, and more particularly, to a monolithic type varistor in which voltage non-linearity is obtained by utilizing a Schottky barrier at the interface of a metal and a semiconductor.

2. Description of the Prior Art

Recently in various types of electronic equipment such as communication devices, miniaturization and integration of electronic components have rapidly proceeded. Correspondingly, the demand for a varistor which is miniaturized or operates a lower voltage has increased.

A monolithic type varistor has been proposed as meeting the above described demands (Japanese Patent Publication No. 23921/1983). The structure of this monolithic type varistor will be described with reference to FIG. 2.

In a monolithic type varistor 1, a plurality of inner electrodes 3*a* to 3*d* are arranged, being separated by semiconductor ceramic layers in a sintered body 2. The inner electrodes 3*a* and 3*c* are led out to one end surface of the sintered body 2 and the inner electrodes 3*b* and 3*d* are led out to the other end surface of the sintered body 2.

First and second outer electrodes 4*a* and 4*b* are respectively formed on both opposed end surfaces of the sintered body 2.

In the fabrication of the device of FIG. 2, green sheets mainly composed of semiconductor ceramics on which conductive paste for forming inner electrodes 3*a* to 3*d* is printed, are first laminated, and the laminated body obtained is pressed in the direction of thickness, and then is fired, to obtain the sintered body 2. Conductive paste is applied and baked on both opposed end surfaces of the sintered body 2 obtained, to form outer electrodes 4*a* and 4*b*, thereby to obtain a monolithic type varistor 1.

In the monolithic type varistor 1, the thickness of the each of the varistor layers 5*a* to 8*c* exhibiting voltage non-linearity can be made smaller than in the case of a single plate type varistor element. Accordingly, the monolithic type varistor 1 has the advantage that the varistor voltage can be effectively reduced.

In the monolithic type varistor 1 shown in FIG. 2, voltage non-linearity is obtained by utilizing by the varistor layers 5*a* to 8*c* arranged between the inner electrodes 3*a* to 3*d*. More specifically, it utilizes voltage non-linearity in grain boundaries between semiconductor particles in each of the varistor layers 5*a* to 5*c*. Consequently, the number of grain boundaries between semiconductor particles between the inner electrodes 3*a* to 3*d* is controlled, to control the varistor voltage, by adjusting the thickness of each of the varistor lagers 5*a* to 5*c* and the firing conditions.

With present ceramic sintering techniques, however it is very difficult to control the particle diameters of the ceramic particles With high precision. For example, particles having diameters two or more times the average particle diameter are very normally formed.

If the above described large particles exist, the varistor voltage is determined by the region in which large particles exist. Consequently the varistor voltage is liable to vary greatly in quantity production.

Furthermore, current concentrations are easily caused in the above described region where the large particles exist, and the withstandable surge current is liable to be smaller.

If the area of the inner electrode is increased, the probability of the existence of large particles becomes high. Accordingly, the withstandable surge current is increased. However, there are limitations on how much the withstandable surge current can be increased by increasing the area of the inner electrode. At present, only a withstandable surge current equivalent to that of a Zener diode, i.e., approximately 100 A, can be obtained.

SUMMARY OF THE INVENTION

An object of the present invention is to provide a monolithic type varistor in which the varistor voltage does not easily vary and the withstandable surge current can be effectively increased.

In the monolithic type varistor according to the present invention, a plurality of inner electrodes are arranged in a sintered body composed of semiconductor ceramics so as to be overlapped with each other while being separated by a semiconductor ceramic layer. First and second outer electrodes are respectively formed on both end surfaces of the sintered body. The plurality of inner electrodes are electrically connected alternately to the first and second outer electrodes in the direction of thickness. Furthermore, in addition to those connected inner electrodes, one or more non connected type inner electrodes, which are not electrically connected to the above outer electrodes, are provided between adjacent ones of the plurality of inner electrodes. Each of the non-connected type inner electrodes is arranged so as to be spaced apart from either the above inner electrode or another non connected type inner electrode by a semiconductor ceramic layer. Furthermore, all of the non-connected type inner electrodes are arranged so as to be spaced apart from each other by semiconductor ceramic layers.

In the monolithic type varistor according to the present invention, voltage non linearity is obtained by Schottky barriers formed at the interface of the above inner electrode and an adjacent semiconductor ceramic layer, and at the interface of the above non connected type inner electrode and an adjacent semiconductor ceramic layer. Furthermore, the number of grain boundaries between semiconductor particles in at least one semiconductor ceramic layer, between a pair of adjacent inner electrodes in non-connected type inner electrodes is controlled, so that the number of grain boundaries in that at least one layer is two or less.

In the monolithic type varistor according to the present invention inner electrodes may be connected to first and second outer electrodes by directly forming outer electrodes on both end surfaces of a sintered body composed of semiconductor ceramics, or by using a sintered body mainly composed of semiconductor ceramics and having low resistance ceramic layers formed from both its end surfaces to the vicinities of the end surfaces, forming first and second outer electrodes on the end surfaces and leading out inner electrodes to the first and second outer electrodes through the low-resistance ceramic layers.

The inventors of the present application considered that a Schottky barrier formed at the interface of an inner electrode and semiconductor particles should be positively utilized as the result of examining a mechanism for obtaining voltage non-linearity in a monolithic type varistor. Varistor characteristics obtained in grain boundaries between the semiconductor particles are stable. However, it is very difficult to make the particle diameters of the semiconductor particles uniform.

On the other hand, a Schottky barrier at the interface of a metal and a semiconductor is determined by its material. Accordingly, the breakdown voltage is constant. Further, if metal electrodes are formed in both ends of a semiconductor layer a symmetrical type varistor is formed. Consequently, if a plurality of metals and semiconductors are laminated, the breakdown voltage is increased by the number of the metals and semiconductors laminated.

The present invention employs a structure in which metals and semiconductor ceramics are laminated on the basis of the above described consideration. In an ordinary bulk type varistor, the current dispersion is large if varistor layers are laminated. On the other hand, in the above described structure utilizing a Schottky barrier formed at the interface of a metal and a semiconductor, the current dispersion is not large and the variation in breakdown voltage is small.

Furthermore, the thickness of a semiconductor layer interposed between electrodes can be decreased by constructing a varistor of a monolithic type. Consequently, the residual resistance can be decreased, the voltage non-linearity index $\alpha$ can be increased and the effective area of the electrode can be increased, thereby making it possible to increase the withstandable surge current.

The above described monolithic type structure utilizing a Schottky barrier can be also formed using single crystals. However, in the case of the structure using single crystals, the cost is significantly high. On the other hand, a technique using green sheets having a very small thickness of less than approximately 10 $\mu$m as can be used for a microchip capacitor or the like has been developed. In the present invention, it is possible to obtain a monolithic type varistor in which voltage non-linearity is further enhanced at low cost by utilizing a technique for handling such green sheets having a very small thickness.

Meanwhile, in the present invention, the value of the number of grain boundaries in at least one semiconductor ceramic layer is set to two or less for the following reasons: In the case of cofiring to obtain a sintered body, when an electrode, particularly an electrode including Pd as an element is used, the electrode absorbs oxygen contained in one or two grain boundaries between semiconductor particles to decrease the level of a Schottky barrier in the grain boundaries so that the effect of varistor characteristics caused by the rain boundaries can be decreased, thereby to make it possible to obtain a stable varistor voltage.

Furthermore, in a structure in which inner electrodes are led out to outer electrodes through low-resistance ceramic layers, the low resistance ceramic layers allow the electric field concentration at the ends of the inner electrodes to be prevented, thereby to make it possible to increase the withstandable surge current. Further, a plating solution or moisture can be prevented from entering the interior of a varistor along the inner electrodes, to enhance plating resistance or moisture resistance. If the plating resistance is enhanced, the electrodes can be prevented from being damaged by solder. Accordingly, the structure can be used for the flow or reflow soldering method.

As a material for constituting a semiconductor ceramic lager, various materials mainly composed of ZnO and $Fe_2O_3$ are considered. Preferably, if the semiconductor ceramic layer is constituted by a material mainly composed of ZnO, a metal material containing 0.01 to 10% by weight of a rare earth oxide Is used as the inner electrode and the non-connected type inner electrode.

It is preferable for the following reasons that the content of the rare earth oxide is in the above described range.

More specifically, if the content of the rare earth oxide is less than 0.0% by weight, oxygen is not diffused in the interface of the inner electrode or the non-connected type inner electrode and the semiconductor ceramic layer, so that a voltage non-linearity index $\alpha$ becomes small. On the other hand, if the content of the rare earth oxide exceeds 10% by weight, the semiconductor ceramic layer is not sufficiently sintered, so that a varistor voltage is significantly increased.

According to the present invention, voltage non-linearity is provided utilizing a Schottky barrier formed in the interface of an inner electrode or a non-connected type inner electrode and a semiconductor ceramic layer. Moreover, the value of the number of grain boundaries between semiconductor particles in at least one semiconductor ceramic layer is controlled to be two or less.

Consequently, the varistor according to the present invention is not easily affected by the voltage non-linearity based on the Schottky barrier in the grain boundaries in the semiconductor ceramic layer. Accordingly, the variation in varistor characteristics can be made small, so that the circuit design becomes easy.

Additionally, since the varistor is constructed as a monolithic type, it is easy to obtain a low-voltage varistor. Further, since a voltage non-linearity index $\alpha$ and the withstandable surge current are large, it is possible to obtain a varistor superior in capacity for surge absorption and suitable for prevention of the ESD fault.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
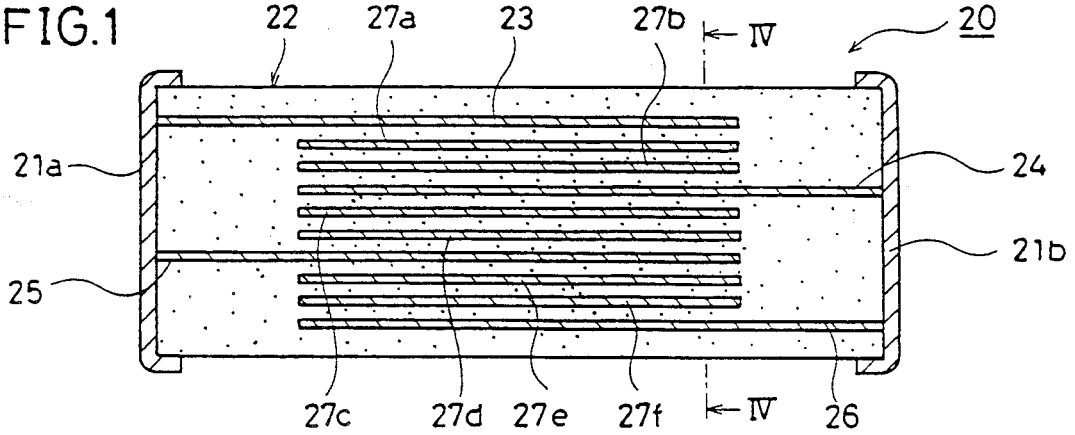
FIG. 1 is a cross sectional view showing a monolithic type varistor according to one embodiment of the present invention.

Description is not made of a nonrestricted embodiment of the present invention to make clear the present invention.

EXAMPLE 1

10% by weight of a glass powder composed of $B_2O_3$, $SiO_2$, PbO and ZnO is added to a ceramics material containing ZnO (95.0 mol %), CoO (1.0 mol %), MoO (1.0 mol %), $Sb_2O_3$ (2.0 mol %) and $Cr_2O_3$ (1.0 mol %) mixed at the above molar ratio, to prepare a raw material.

An organic binder is mixed with the above described raw material, to respectively form green sheets having thicknesses of 5 μm, 10 μm, 15 μm, 20 μm and 30 μm by the reverse roller method. The above described green sheet is cut to a rectangular shape of a predetermined size The plane shape of the cut green sheet is represented by reference numeral 11 in FIG. 3A.

Figure 3A:
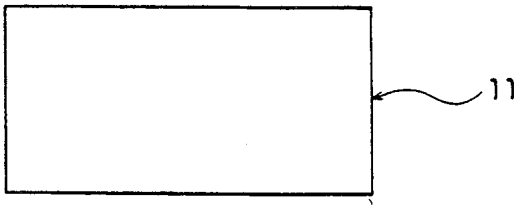
FIGS. 3A to 3D are plan views respectively showing ceramic green sheets for obtaining the monolithic type varistor according to one embodiment of the present invention and the shapes of conductive paste patterns applied thereon.
Figure 3B:
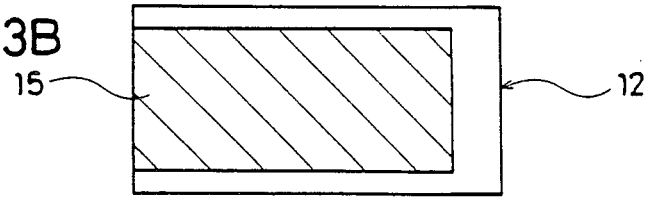
Figure 3C:
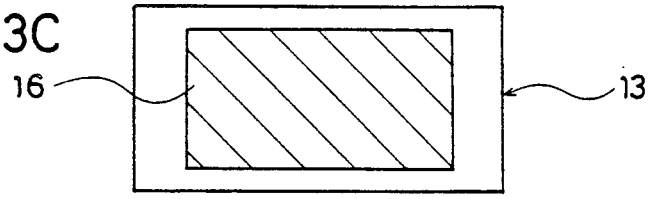
Figure 3D:
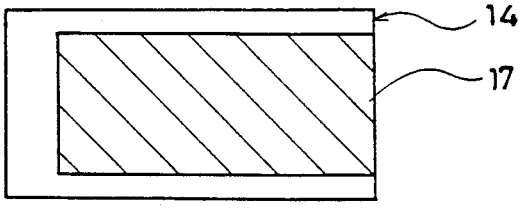

Conductive paste obtained by adding an organic vehicle to a metal powder containing Ag and Pd mixed at the weight ratio of 7:3 is then printed on the ceramic green sheet 11, to respectively prepare ceramic green sheets 12 to 14 shown in FIGS. 3B to 3D. In FIGS. 3B to 3D, the plane shapes the conductive paste 15 to 17 printed are respectively represented by hatching.

The ceramic green sheets 11 to 14 prepared in the above described manner are laminated in the order of, for example, ten ceramic green sheets 11, one ceramic green sheet 12, two ceramic green sheets 13, one ceramic green sheet 14, two ceramic green sheets 13, one ceramic green sheet 12, two ceramic green sheets 13 and one ceramic green sheet 14, and pressed by applying a pressure of 2t/cm$^2$ in the direction of thickness, to obtain a laminated body. The laminated body is cut to a predetermined size.

Figure 4:
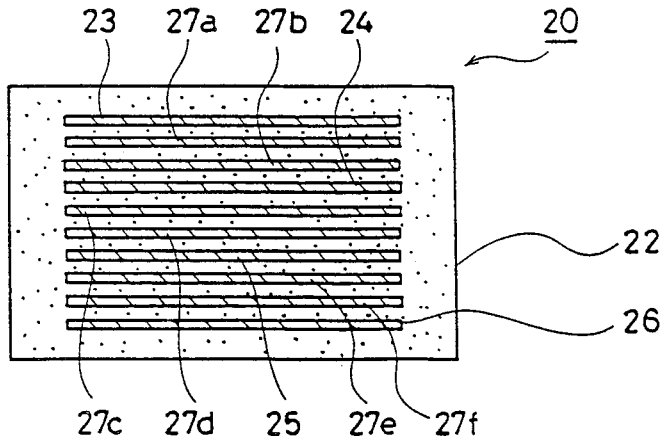
FIG. 4 is a cross sectional view taken along a line IV—IV shown in FIG. 1.
Figure 2:
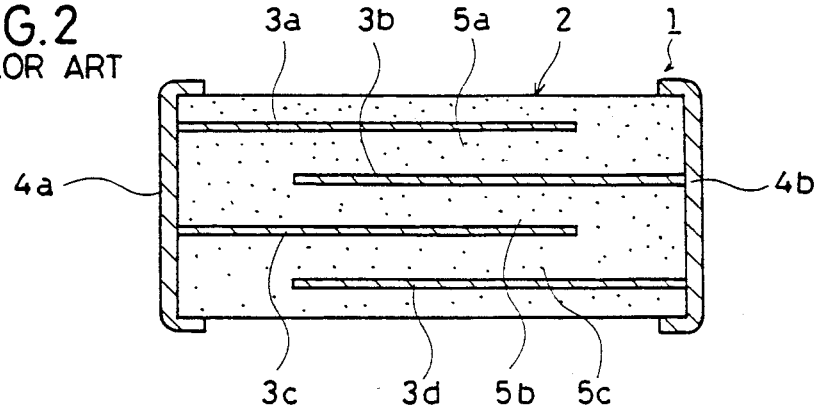
FIG.2 PRIOR ART
FIG. 2 is a cross sectional view showing a conventional monolithic type varistor.

A formed body obtained in the above described manner is fired in air at temperatures from 950° to 1050° C. for three hours, to obtain a sintered body 22 shown in FIGS. 1 and 4. Conductive pastes obtained by mixing 5% by weight of glass composed of $B_2O_3$, $SiO_2$, ZnO, $Bi_2O_3$ and PbO and a suitable amount of varnish with a metal powder containing Ag and Pd at the weight ratio of 7:3 is applied to both end surfaces of this sintered body 22 and baked at a temperature of 600° C. for ten minutes, thereby to obtain a monolithic type varistor 20 shown in FIGS. 1 to 4.

In FIG. 1, reference numerals **21*a* and 21*b* designate first and second outer electrodes formed by the above described baking. Further, inner electrodes based on conductive paste 15 to 17 are formed in the sintered body 22. More specifically, inner electrodes 23, 24, 25 and 26 based on the conductive paste 15 and 17 are arranged so as to be overlapped with each other while being separated by a semiconductor ceramic layer such that they are led out to both end surfaces of the sintered body 22, and are alternately led out to the opposed end surfaces of the sintered body 22**.

Furthermore, non-connected type inner electrodes **27*a* to 27*f* based on the conduct paste 16 are arranged between the inner electrodes 23 to 26**.

Voltage/current characteristics of the monolithic type varistor 20 obtained in the above described manner and the change in varistor voltage at the time of applying a triangular current wave having a waveform of 8×20 microseconds (the intensity is 300 A) (a voltage between the outer electrodes at the time of causing a current of 1 mA to flow) are shown in Table 1 as described later.

EXAMPLE 2

10% by weight of a glass powder composed of $B_2O_3$, $SiO_2$, PbO and ZnO is added to a ceramics material containing ZnO (95.0 mol %), CoO (1.0 mol %), MoO (1.0 mol %), $Sb_2O_3$ (2.0 mol %) and $Cr_2O_3$ (1.0 mol %) mixed at the above molar ratio to prepare a raw material and an organic binder is further mixed with the raw material, to form a green sheet having a thickness of 10 μm by the reverse roller method.

The above described green sheet is cut to a rectangular shape of a predetermined size, to obtain a green sheet 11 shown in FIG. 3A. Further, in the same manner as that in Example 1, conductive pastes obtained by mixing an organic vehicle with a metal powder containing Ag and Pd at the weight ratio of 7:3 are printed, to respectively prepare ceramic green sheets 12 to 14 shown in FIGS. 3B to 8D on which conductive pastes 15 to 17 are printed.

The above described ceramic green sheets 11 to 14 are laminated in the same procedure as that in Example 1 to obtain a laminated body. The laminated body is cut to a predetermined size.

The above described ceramic green sheet 11 having a thickness of 10 μm is hot-pressed onto both end surfaces of the laminated body obtained from the side at a temperature of 80° C. and at a pressure of 50 Kg/cm$^2$ for thirty seconds and then, fired in air at temperatures from 950° to 1050° C. for three hours to obtain a sintered body.

Conductive pastes mainly composed of Al are applied to both end surfaces of the sintered body obtained and heat-treated at a temperature of 850° C. for ten minutes, and conductive pastes obtained by mixing 5% by weight of glass composed of $B_2O_3$, $SiO_2$, ZnO, $Bi_2O_3$ and PbO and a suitable amount of varnish with a metal powder containing Ag and Pd at the weight ratio of 7:3 are further applied to outer parts thereof and baked at a temperature of 600° C. for ten minutes, to form first and second outer electrodes. A monolithic type varistor obtained is shown in FIG. 5.

Figure 5:
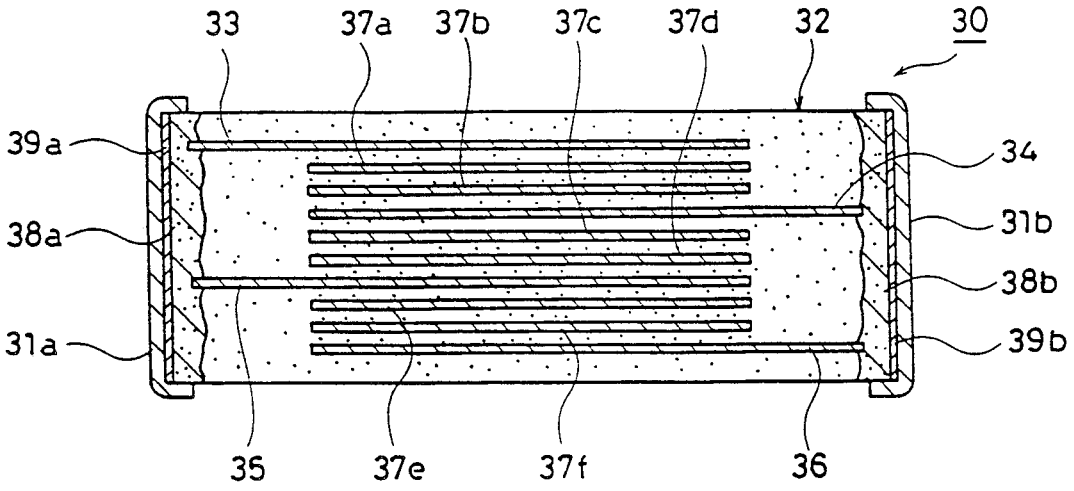
FIG. 5 is a plan view showing a monolithic type varistor according to another embodiment of the present invention.

As obvious from FIG. 5, in a monolithic type varistor 30, inner electrodes 33, 34, 35 and 36 are arranged in a sintered body 32 so as to be overlapped with each other while being separated by a semiconductor ceramic layer. Further, non-connected type inner electrodes **37*a* to 37*f* based on the conductive paste 16 are arranged between the inner electrodes 33 to 36**.

The monolithic type varistor 30 is the same as the monolithic type varistor 20 shown in FIG. 1 which is fabricated in Example 1 except in portions to which the inner electrodes 33 to 36 are led out. More specifically, Al paste is baked on end surfaces of the sintered body obtained by pressing the above described green sheet having a thickness of 10 μm onto the opposed end surfaces of the monolithic type varistor and firing the same, to form low resistance ceramic layers **38*a* and 38*b* on the opposed end surfaces of the sintered body 32. The low-resistance ceramic layers 38*a* and 38*b* are formed by diffusing Al in the semiconductor ceramic layer or reducing ZnO with Al. The above described inner electrodes 33 to 36 are formed so as to lead to the low-resistance ceramic layers 38*a* and 38*b***.

Furthermore, Al conductive layers 39a and 39b serving as Al supply layer for forming low resistance ceramic layers are formed outside of the low resistance ceramic layers 38a and 38b. Further, first and second outer electrodes 31a and 31b are formed outside of the conductive layers 39a and 39b.

Voltage/current characteristics of the monolithic type varistor 30 obtained in the above described manner and the change in varistor voltage at the time of applying a triangular current wave having intensity of 300 A and a waveform of 8×20 microseconds (a voltage between the outer electrodes at the tie of causing a current of 1mA to flow) are shown in Table 1.

TABLE 1

| | Thickness of Green Sheet | N | n | Average Value $V_{1mA}$ (V) | Maximum Value $V_{1mA}$ (V) | Minimum Value $V_{1mA}$ (V) | $\alpha_{0.1-1}$ | $\Delta V_{1mA}$ (%) |
|---|---|---|---|---|---|---|---|---|
| Example 1 | 5 | 3 | 3 | 12.5 | 12.9 | 12.1 | 34.4 | −0.8 |
| " | 10 | 3 | 2 | 8.5 | 8.8 | 8.3 | 35.3 | −0.5 |
| " | 10 | 3 | 3 | 12.6 | 12.8 | 12.2 | 37.6 | −0.1 |
| " | 10 | 3 | 4 | 16.8 | 17.2 | 16.4 | 40.5 | −0.3 |
| " | 10 | 3 | 5 | 20.9 | 21.2 | 20.4 | 33.1 | −0.2 |
| " | 10 | 5 | 2 | 8.5 | 8.7 | 8.2 | 40.4 | −0.4 |
| " | 10 | 5 | 3 | 12.4 | 12.8 | 12.1 | 36.7 | −0.3 |
| " | 10 | 5 | 4 | 16.6 | 17.0 | 16.2 | 34.2 | −0.1 |
| " | 10 | 5 | 5 | 20.7 | 21.1 | 20.3 | 37.3 | −0.2 |
| " | 10 | 7 | 2 | 8.4 | 8.7 | 8.1 | 35.1 | +0.1 |
| " | 10 | 7 | 3 | 12.2 | 12.7 | 11.8 | 40.9 | +0.5 |
| " | 10 | 7 | 4 | 16.3 | 17.0 | 15.8 | 38.2 | +0.2 |
| " | 10 | 7 | 5 | 20.5 | 21.0 | 19.7 | 41.5 | +0.4 |
| " | 15 | 3 | 3 | 12.9 | 13.2 | 12.6 | 33.7 | −0.9 |
| " | 20 | 3 | 3 | 13.4 | 13.8 | 13.0 | 32.4 | −1.6 |
| Outside Invention | 30 | 3 | 1 | 13.4 | 14.7 | 12.0 | 26.4 | −7.8 |
| | 30 | 3 | 3 | 40.4 | 44.6 | 37.1 | 22.6 | −8.4 |
| Example 2 | 10 | 3 | 3 | 12.8 | 13.2 | 12.3 | 37.6 | +0.1 |

Description of Table 1

In Table 1, reference character N designates the number of semiconductor ceramic layers divided by inner electrodes between the outermost inner electrodes. For example, in FIG. 1, it is considered that three semiconductor ceramic layers divided by the inner electrodes 23 to 26 exist between the inner electrodes 23 to 26.

Reference character n designates the number of semiconductor ceramic layers divided by non connected type inner electrodes between the adjacent inner electrodes, for example, three in the example of FIG. 1.

Evaluation of Examples 1 and 2

As the result of grinding and chemically etching the monolithic type varistors prepared in Examples 1 and 2, it is confirmed that the particle diameters of semiconductor ceramic particles are 4.2 μm on average, and the minimum number of grain boundaries in a semiconductor ceramic layer is three in the case of samples in which a green sheet has a thickness of 30 μm. More specifically, samples in which a green sheet has a thickness of 30 μm in Table 1 are outside the present invention.

As can be seen from the results in Table 1, in monolithic type varistors using green sheets having thicknesses of 5, 10, 15 and 20 μm, that is, monolithic type varistors within the scope of the present invention in which the minimum number of grain boundaries in the semiconductor ceramic layer is two or less, larger voltage non-linearity indexes $\alpha_{0.1-1}$ than those of monolithic type varistors outside the present invention using a green sheet having a thickness of 30 μm are exhibited, and changes $\Delta V_{1mA}$ in varistor voltage are significantly smaller.

EXAMPLE 3

$Co_3O_4$, MgO, $Cr_2O_3$ and $K_2CO_3$ are converted to Co, Mg, Cr and K, respectively weighed and added to ZnO at the ratio of 2.0 atom %, 0.1 atom %, 0.1 atom % and 0.1 atom %, and mixed by a ball mill using demineralized water for twenty four hours. Then, a mixture obtained is filtered and dried and calcined at temperatures from 700° to 900° C. for two hours and then, ground again.

An organic binder is mixed with a raw material obtained by grinding and a green sheet having a uniform thickness of 10 μm is formed by the doctor blade process and then, the green sheet is cut to a rectangular shape. A green sheet 11 obtained is shown in FIG. 3A.

On the other hand, 0.01 to 10% by weight of $Pr_6O_{11}$ is added to a paste obtained by mixing a vehicle with Pt, to form conductive pastes. As shown in FIGS. 3B to 3D, the conductive pastes are printed on the upper surface of the above described green sheet by screen-process printing. The shapes of conductive pastes 15 to 17 printed are represented by hatching.

Green sheets 11 to 14 obtained are overlapped with each other in the same manner as that in Example 1, pressed at a pressure of 2t/cm$^2$ and cut to a predetermined size.

A laminated body obtained is fired in air at temperatures from 1100° to 1300° C. for three hours and Ag pastes are applied to its ends and then, baked at a temperature of 600° C. for ten minutes, to obtain a monolithic type varistor having the same structure as that shown in FIG. 1.

With respect to the monolithic type varistor according to the present embodiment obtained in the above described manner, a varistor voltage $V_{1mA}$, voltage non-linearity indexes $\alpha_{10-7/10-6A}$ and $\alpha_{10-3/10-2A}$, the change in the varistor voltage $V_{1mA}$ at the time of applying a triangular current wave having intensity of 300 A and a waveform of 8×20 microseconds twice at intervals of five minutes are shown in Table 2.

Furthermore, for comparison, the same measurements are made of a monolithic type varistor so constructed that no rare earth oxide is contained in an inner electrode material. A sintered body of the monolithic type varistor in this comparative example has the composition in which $Pr_6O_{11}$, $Co_3O_4$, MgO, $Cr_2O_3$ and $K_2CO_3$ are converted to Co, Mg, Cr and K and respectively added to ZnO at the ratio of 0.5 atom %, 2.0 atom %, 0.1 atom %, 0.1% atom and 0.1 atom % (sample number 10).

In Table 2, a sample marked with is a sample using an electrode material having a content of a rare earth oxide out of range of 0.01 to 10% by weight.

TABLE 2

| Sample Number | $Pr_6O_{11}$ (% by Weight) | $V_{1mA}$ (V) | $\alpha_{10^{-7}/10^{-6}A}$ | $\alpha_{10^{-3}/10^{-2}A}$ | $\Delta V_{1mA}/V_{1mA}$ (%) |
|---|---|---|---|---|---|
| 1* | 0.0 | 18.3 | 8.4 | 13.0 | −20.4 |
| 2* | 0.005 | 17.4 | 8.0 | 14.0 | −8.3 |
| 3 | 0.01 | 12.7 | 30.0 | 34.0 | −0.4 |
| 4 | 0.1 | 12.0 | 35.0 | 35.0 | −0.5 |
| 5 | 1.0 | 12.5 | 31.0 | 30.0 | −0.1 |
| 6 | 5.0 | 13.0 | 30.0 | 34.0 | −0.2 |
| 7 | 10.0 | 13.4 | 31.0 | 31.0 | −0.4 |
| 8* | 20.0 | 35.1 | 18.0 | 14.0 | −15.7 |
| 9* | 30.0 | 62.7 | 20.0 | 19.0 | −18.7 |
| 10* | 0.0 | 12.8 | 12.7 | 35.0 | −8.5 |

EXAMPLE 4

$Co_3O_4$, MgO, $Cr_2O_3$, and $K_2CO_3$ are converted to CO, Mg, Cr and K, respectively weighed and added to ZnO at the ratio of 2.0 atom %, 0.1 atom %, 0.1 atom % and 0.1 atom %, and mixed by a ball mill using demineralized water for twenty four hours. Then, a mixture obtained is filtered and dried, calcined at temperatures from 700° to 900° C. for two hours and then, ground again.

An organic binder is mixed with a raw material obtained by grinding and a green sheet, having a uniform thickness of 10 μm is formed by the doctor blade process and then, the green sheet is cut to a rectangular shape.

On the other hand, 0.01 to 10% by weight of $Pr_6O_{11}$ is added to a paste obtained by mixing a vehicle with Pt, to form conductive pastes. In the same manner as that in Example 2, the conductive pastes are printed on the upper surface of the above described green sheet by screen-process printing. In such a manner, green sheets 12 to 14 shown in FIG. 3B to 3D are obtained. Further, the ceramic green sheets 11 to 14 are overlapped with each other in the same manner as that in Example 2, pressed at a pressure of $2t/cm^2$ and cut to a predetermined size. The above described green sheet having a thickness of 10 μm is hot-pressed onto end surfaces of a laminated body obtained at a temperature of 80° C. and at a pressure of 50 $kg/cm^2$ for thirty seconds and then, fired in air at temperatures from 1100° to 1300° C. for three hours.

Al paste is applied to end surfaces of a sintered body obtained, heat-treated at a temperature of 850° C. for ten minutes and then, Ag paste is applied to the end surfaces and baked at a temperature of 600° C. for ten minutes, to form low-resistance ceramic layers.

With respect to a monolithic type varistor thus fabricated (having a structure shown in FIG. 5) according to the present embodiment, a varistor voltage $V_{1mA}$, voltage non-linearity indexes $\alpha_{10-7/10-6A}$ and $\alpha_{10-3/10-2A}$, and the change in the varistor voltage $V_{1mA}$ at the time of applying a triangular current wave having intensity of 300 A and a waveform of 8×20 microseconds twice at intervals of five minutes are shown in Table 3.

Furthermore, for comparison, the same measurements are made of a monolithic type varistor containing no rare earth oxide in an inner electrode material. Meanwhile, this monolithic type varistor has the composition in which $Pr_6O_{11}$, $Co_3O_4$, MgO, $Cr_2O_3$ and $K_2CO_3$ are converted to Co. Mg. Cr and K and respectively added to ZnO at the ratio of 0.5 atom %, 2.0 atom %, 0.1 atom %, 0.1 atom % and 0.1 atom % (sample number 20).

In Table 3, a sample with an asterisk is a sample using an electrode material having a content of $Pr_6O_{11}$ serving as a rare earth oxide outside of 0.01 to 10% by weight.

TABLE 3

| Sample Number | $Pr_6O_{11}$ (% by Weight) | $V_{1mA}$ (V) | $\alpha_{10^{-7}/10^{-6}A}$ | $\alpha_{10^{-3}/10^{-2}A}$ | $\Delta V_{1mA}/V_{1mA}$ (%) |
|---|---|---|---|---|---|
| 11* | 0.0 | 19.1 | 7.3 | 12.0 | −20.0 |
| 12* | 0.005 | 18.7 | 7.0 | 18.0 | −15.3 |
| 13 | 0.01 | 13.1 | 35.0 | 50.0 | −0.8 |
| 14 | 0.1 | 12.8 | 34.0 | 34.0 | −0.2 |
| 15 | 1.0 | 12.9 | 30.0 | 31.0 | −0.4 |
| 16 | 5.0 | 13.5 | 36.0 | 38.0 | −0.5 |
| 17 | 10.0 | 13.7 | 31.0 | 34.0 | −0.3 |
| 18* | 20.0 | 36.8 | 17.0 | 14.0 | −10.3 |
| 19* | 30.0 | 66.4 | 19.0 | 20.0 | −12.4 |
| 20* | 0.0 | 13.0 | 12.8 | 35.0 | −7.3 |

TABLE 4

| Sample Number | Rare Earth Oxide | $V_{1mA}$ (V) | $\alpha_{10^{-7}/10^{-6}A}$ | $\alpha_{10^{-3}/10^{-2}A}$ | $\Delta V_{1mA}/V_{1mA}$ (%) |
|---|---|---|---|---|---|
| 21 | $La_2O_3$ | 13.0 | 31 | 34 | −0.7 |
| 22 | $Sm_2O_3$ | 13.4 | 30 | 32 | −0.4 |
| 23 | $Ce_2O_3$ | 12.7 | 35 | 37 | −0.3 |
| 24 | $Pr_6O_{11}$: 0.5 (% by Weight) $La_2O_3$: 0.5 (% by Weight) | 12.9 | 32 | 34 | −0.2 |
| 25 | $Pr_6O_{11}$: 0.5 (% by Weight) $Sm_2O_3$: 0.5 (% by Weight) | 13.1 | 32 | 30 | −0.4 |
| 26 | $Pr_6O_{11}$: 0.5 (% by Weight) $Ce_2O_3$: 0.5 (% by Weight) | 13.5 | 30 | 32 | −0.7 |
| 27 | $La_2O_3$: 0.5 (% by Weight) $Sm_2O_3$: 0.5 (% by Weight) | 13.1 | 31 | 30 | −0.3 |

EXAMPLE 5

As an inner electrode material, ones obtained by adding to Pt 1.0% by weight of at least one type of rare earth oxide out of rare earth oxides $Pr_6O_{11}$, $La_2O_3$, $Sm_2O_3$ and $Ce_2O_3$ in combinations as shown in Table 4 are used. Samples of a monolithic type varistor are fabricated in the same manner as that in Example 3 except that conductive paste mainly composed of the above materials are used. The same measurements as those in Example 3 is made of the samples, and the results are shown in Table 4.

As obvious from Table 4, a rare earth oxide to be contained in an inner electrode material is not limited to $Pr_6O_{11}$ shown in Table 1. For example, at least one type of arbitrary rare earth oxide out of $La_2O_3$, $Sm_2O_3$ and $Ce_2O_3$ may be contained, in which case the same degree of characteristics can be obtained.

Furthermore, this shows that the rare earth oxide is not limited to the above described $Pr_6O_{11}$, $La_2O_3$, $Sm_2O_3$ and $Ce_2O_3$ and other oxides of rare earth elements (Nd, Pm, En, Gd, TB, Dy, Ho, Er, Tm, Yb, Lu, Sc, Y) within the scope of the gist of the present invention can be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A monolithic type varistor comprising:

a sintered body composed of semiconductor ceramics;

a plurality of inner electrodes arranged in said sintered body so as to be overlapped with each other while being separated by semiconductor ceramic layers and alternately led out to both end surfaces of the sintered body;

first and second outer electrodes respectively formed on the end surfaces of said sintered body; and one or more non-connected type inner electrodes arranged between adjacent ones of said plurality of inner electrodes and arranged so as not to be electrically connected to said outer electrodes, each one of the non-connected type inner electrodes being spaced apart from adjacent inner electrodes or non-connected type inner electrodes while being separated therefrom by semiconductor ceramic layers, voltage non-linearity being obtained by Schottky barriers formed at the interface of each inner electrode and non-connected type inner electrode and the adjacent semiconductor ceramic layers, and the number of grain boundaries between semiconductor particles in at least one of the semiconductor ceramic layers between the inner electrodes and the non-connected type inner electrodes being two or less.

2. The monolithic type varistor according to claim 1, wherein said semiconductor ceramics is mainly composed of zinc oxide, and said inner electrode and said non-connected type inner electrode are constituted by a metal material containing 0.01 to 10% by weight of a rare earth oxide.

3. The monolithic type varistor according to claim 1, wherein a plurality of non connected type inner electrodes are arranged between said inner electrodes adjacent to each other in the direction of thickness.

4. The monolithic type varistor according to claim 1, wherein equal numbers of non-connected type inner electrodes are respectively arranged among said inner electrodes adjacent to each other in the direction of thickness.

5. The monolithic type varistor according to claim 1, wherein said non-connected type inner electrode is formed to have the same width as that of said inner electrode.

6. A monolithic type varistor comprising:

a sintered body mainly composed of semiconductor ceramics and provided with low-resistance ceramic layers from both its end surfaces to regions in the vicinities of the end surfaces;

a plurality of inner electrodes arranged in said sintered body so as to be overlapped with each other while being separated by semiconductor ceramic layers and alternately led out to the low-resistance ceramic layers on the side of the end surfaces;

first and second outer electrodes respectively formed on both end surfaces of said sintered body; and one or more non-connected type inner electrodes arranged between adjacent ones of said plurality of inner electrodes and arranged so as not to be electrically connected to said outer electrodes, each one of the non-connected type inner electrodes being spaced apart from adjacent inner electrodes or non-connected type inner electrodes while being separated therefrom by semiconductor ceramic layers, voltage non-linearity being obtained by Schottky barriers formed at the interface of each inner electrode and non-connected type inner electrode and the adjacent semiconductor ceramic layers, and the number of grain boundaries between semiconductor particles in at least one of the semiconductor ceramic layers between the inner electrodes and the non-connected type inner electrodes being two or less.

7. The monolithic type varistor according to claim 6, characterized in that said semiconductor ceramics is mainly composed of zinc oxide, and said inner electrode and said non-connected type inner electrode are composed of a metal material containing 0.01 to 10% by weight of a rare earth oxide.

8. The monolithic type varistor according to claim 6, wherein a plurality of non-connected type inner electrodes are arranged between said inner electrodes adjacent to each other in the direction of thickness.

9. The monolithic type varistor according to claim 6, wherein equal numbers of non-connected type inner electrodes are respectively formed among said inner electrodes adjacent to each other in the direction of thickness.

10. The monolithic type varistor according to claim 6, wherein said non-connected type inner electrode is formed to have the same width as that of said inner electrode.

* * * * *